US006247182B1

(12) United States Patent
Tasbas

(10) Patent No.: US 6,247,182 B1
(45) Date of Patent: Jun. 19, 2001

(54) STOCKING DEVICE

(76) Inventor: Hedy T. Tasbas, 8 Chesham Way, Fairport, NY (US) 14450

( * ) Notice: Subject to any disclaimer, the term of this patent is extended or adjusted under 35 U.S.C. 154(b) by 0 days.

(21) Appl. No.: 09/473,610

(22) Filed: Dec. 29, 1999

(51) Int. Cl.[7] ..... A43B 17/00
(52) U.S. Cl. ..... 2/239
(58) Field of Search ..... 2/239, 240, 241, 2/242, 1, 455, 61, 245; 239/34; 36/10; 442/96

(56) References Cited

U.S. PATENT DOCUMENTS

| | | | | |
|---|---|---|---|---|
| 832,550 | * | 10/1906 | Lepper | 2/239 |
| 962,089 | * | 6/1910 | Newton | 2/241 |
| 1,293,399 | * | 2/1919 | Fry | 2/239 |
| 2,649,588 | * | 8/1953 | Kantor | 2/61 |
| 3,102,271 | * | 9/1963 | Wilkerson | 2/239 |
| 3,146,468 | * | 9/1964 | McDonlad | 2/239 |
| 3,274,709 | * | 9/1966 | Lipinski | 36/10 |
| 3,334,356 | * | 8/1967 | Abel | 2/239 |
| 3,417,408 | * | 12/1968 | Caggiano | 2/239 |
| 3,887,946 | * | 6/1975 | Laskin et al. | 2/239 |
| 4,069,515 | * | 1/1978 | Swallow et al. | 2/239 |
| 4,069,600 | * | 1/1978 | Wise | 36/10 |
| 4,155,123 | * | 5/1979 | Popper | 2/239 |
| 4,206,514 | * | 6/1980 | Yamauchi | 2/239 |
| 4,228,549 | * | 10/1980 | Rispoli | 2/239 |
| 4,296,499 | * | 10/1981 | Patterson et al. | 2/239 |
| 4,419,396 | * | 12/1983 | Sugimoto | 428/40 |
| 4,615,188 | * | 10/1986 | Hursh et al. | 66/196 |
| 4,735,010 | * | 4/1988 | Grinarml | 43/1 |
| 5,560,226 | * | 10/1996 | Throneburg | 66/185 |
| 5,603,232 | * | 2/1997 | Throneburg | 66/185 |
| 5,675,992 | * | 10/1997 | Wrightenberry | 66/178 R |
| 5,682,617 | * | 11/1997 | Tumas | 2/239 |
| 5,724,836 | * | 3/1998 | Green | 66/185 |
| 5,740,559 | * | 4/1998 | Thiel | 2/239 |
| 5,778,702 | * | 7/1998 | Wrightenberry | 66/178 R |
| 5,809,577 | * | 9/1998 | Getz | 2/406 |
| 5,823,432 | * | 10/1998 | Hogan | 239/36 |
| 5,867,838 | * | 2/1999 | Corry | 2/239 |
| 6,041,443 | * | 3/2000 | Pas et al. | 2/239 |
| 6,044,497 | * | 4/2000 | Richardson | 2/239 |
| 6,047,434 | * | 4/2000 | Falwell | 15/227 |
| 6,089,953 | * | 7/2000 | Chen | 450/1 |

* cited by examiner

*Primary Examiner*—John J. Calvert
*Assistant Examiner*—Alissa L. Hoey
(74) *Attorney, Agent, or Firm*—Greenwald & Basch:; Howard J. Greenwald

(57) ABSTRACT

A foot protector which is comprised of at least about 80 weight percent of a fabric material. The fabric material is comprised of at least 50 weight percent of stretch fabric, it is made from a two sheets of fabric, and a space between the two sheets of fabric is adapted to receive volatilizable material. A hole extends through the first sheet of fabric, and the hole has a diameter of less than about 0.3 inches. A volatilizable material is disposed within the space disposed between the two sheets of fabric.

15 Claims, 2 Drawing Sheets

STOCKING DEVICE

FIELD OF THE INVENTION

A foot protector formed from a fabric with an inner wall, and outer wall, and a space disposed between such walls, wherein the foot protector is comprised of a hole extending through one of such walls adapted to receive material through such hole.

BACKGROUND OF THE INVENTION

Foot protectors are well known to those skilled in the art. Thus, by way of illustration and not limitation, foot protectors are disclosed, e.g., in U.S. Pat. Nos. 5,872,068 (foot protector made from a fabric containing a microbial adsorbent), 5,855,078 (knit foot protector), 5,774,898 (athletic foot protector), 5,603,232 (foot protector for use in combination with hosiery), 5,335,517, 4,373,361, 4,277,959, 4,255,949, 4,194,249, 4,069,600, and the like. The disclosure of each of these United States patents is hereby incorporated by reference into this specification.

To the best of applicant's knowledge, none of the prior art foot protectors enables a user to readily insert a desired material (such as a scented material, a medicinal material, and the like) into a foot protector which is adapted to retain such material within it for a relatively long period of time. It is an object of this invention to provide such a foot protector.

SUMMARY OF THE INVENTION

In accordance with this invention, there is provided a foot protector consisting of at least about 80 weight percent of fabric material, wherein (a) the fabric material is comprised of a first sheet of fabric a second sheet of fabric, fabric wall, and a space disposed between the first and second sheets of fabric; (b) said fabric material is an integral structure comprised of a first wall and a second wall, and (c) a hole extends through the first sheet of fabric of said first wall.

BRIEF DESCRIPTION OF THE DRAWINGS

The invention will be described by reference to the enclosed drawings, in which like numerals refer to like elements, and in which.

DESCRIPTION OF THE PREFERRED EMBODIMENTS

Figure 1:
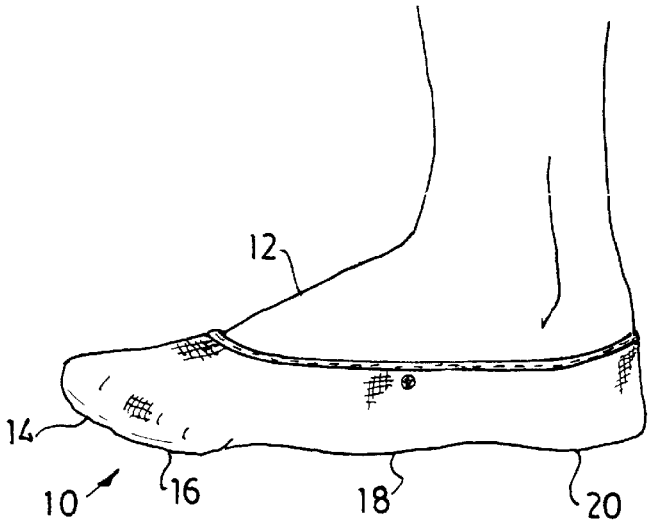
FIG. 1 is a perspective view one preferred foot protector of this invention being worn by a user.

FIG. 1 is a perspective view of foot protector 10, showing it disposed on foot 12. It will be seen that, in this preferred embodiment, foot protector 10 is preferably an integral structure in the form of a typical sock construction with a toe portion 14, a ball portion 16, an arch portion 18, and a heel pocket 20.

The term "foot protector," as used in this specification, denotes a fabric article which covers some or all of a person's foot and may extend only over the toes, only over the mid-portion of the foot, only to the heel section of the foot, to the ankle of the foot, to the knee, or to the thigh. All of these articles of clothing are "foot protectors" as that term is used in this specification.

In one embodiment, the foot protector 10 is manually sewn together. In another embodiment, The foot protector 10 is integrally knit on a sock knitting machine. Sock knitting machines, the fabrics they use, and the socks they produce, are well known to those skilled in the art. Reference may be had, e.g., to U.S. Pat. Nos. 5,899,006 (circular sock knitting machine), 5,791,163, 5,551,260, 5,207,763, 5,056,200, 5,004,132, 4,993,218, 4,829,790, 4,752,044, 4,291,554, 4,228,549, 4,072,029, 4,064,724, 4,033,151, 3,881,327, and the like. The disclosure of each of these United States patents hereby incorporated by reference into this specification.

The foot protector 10 is comprised of at least about 50 weight percent of stretch fabric and, preferably, at least about 60 weight percent of stretch fabric. One may use one or more of the stretch fabrics known to those skilled in the art such as, e.g., the stretch fabrics disclosed in U.S. Pat. Nos. 5,784,806 (woven weft stretch fabrics), 5,164,262, 5,074,285, 4,181,982 (nylon or any other stretch fabric commonly used in stockings), 3,901,001 (knit stretch fabric), 3,828,537, 3,675,408, and the like. The disclosure of each of these United States patents is hereby incorporated by reference into this specification.

In one embodiment, the stretch fabric is comprised of at least about 60 percent of nylon and spandex. As is known to those skilled in the art, "spandex" is the generic name for a fiber in which the fiber-forming substance is a long-chain synthetic polymer comprised of at least 85 percent of a segmented polyurethane. In one embodiment, the stretch fabric is comprised of 91 percent of nylon and 9 percent of spandex. In another embodiment, the stretch fabric is comprised of 87 percent of nylon and 13 percent of spandex.

Figure 2:
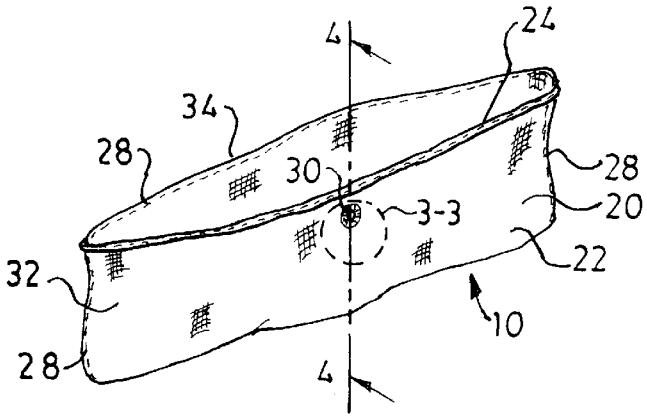
FIG. 2 is a perspective view of the foot protector of FIG. 1.
Figure 4:
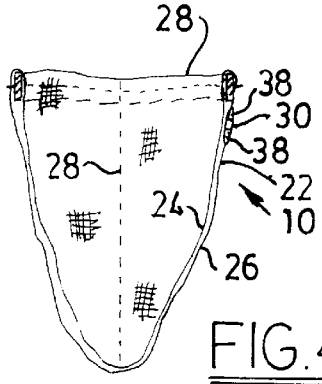
FIG. 4 is an end view of the foot protector of FIG. 2.

Referring again to FIG. 2, and in the preferred embodiment depicted therein, it will be seen that foot protector 10 is made from a fabric material 20 which is comprised of a first sheet of fabric 22, a second sheet of fabric 24, and a space 26 disposed between such first sheet of fabric 22 and said second sheet of fabric 24. The first sheet of fabric 22 and the second sheet of fabric 24 are joined together by conventional means such as, e.g., stitching 28.

Referring again to FIG. 2, and in the preferred embodiment depicted therein, it will be seen that a hole 30 extends through the first sheet of fabric 22 on the first side 32 of foot protector 10. In another embodiment, a hole (not shown) extends through the first sheet of fabric on the second side 34 of foot protector 10. In yet another embodiment, not shown, a hole extends through the first sheet of fabric on both side 32 and side 34 of foot protector 10.

Except for the hole 30, substantially all of the volume of space 26 is encompassed by either the first sheet of fabric 22 and/or the second sheet of fabric 24. In the preferred embodiment illustrated in FIG. 2, at least about 95 volume percent of the space 26 is enclosed by either the first sheet of fabric and/or the second sheet of fabric.

Figure 3:
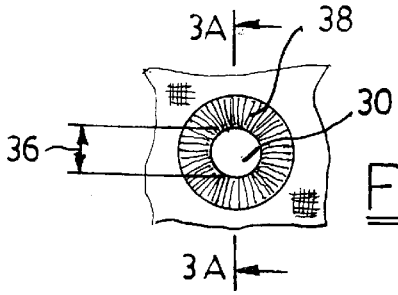
FIG. 3 is an enlarged partial view of the foot protector of FIG. 2.
Figure 3A:
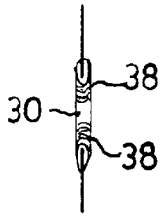
FIG. 3A is a sectional view of the foot protector of FIG. 2.

The hole 30 is shown in enlarged detail in FIG. 3. Hole 30 is preferably a reinforced opening, and it may be reinforced by conventional means, such as by a grommet, by fabric, etc. Reference may be had, e.g., to United States Pat. Nos. 32,443 (grommet reinforced openings), 5,540,177, 5,029,345 (fabric reinforced openings), 5,016,284 (eyelet reinforced openings), 5,016,284 (grommet reinforced openings), and the like. The disclosure of each of these United States patents hereby incorporated by reference into this specification.

Referring again to FIG. 3, it will be seen that, in the preferred embodiment depicted, the hole 30 has a diameter 36 which is less than about 0.3 inches and, preferably, less than about 0.2 inches. In the embodiment depicted in FIG. 3, a mesh fabric 38 reinforces hole 30.

Figure 5:
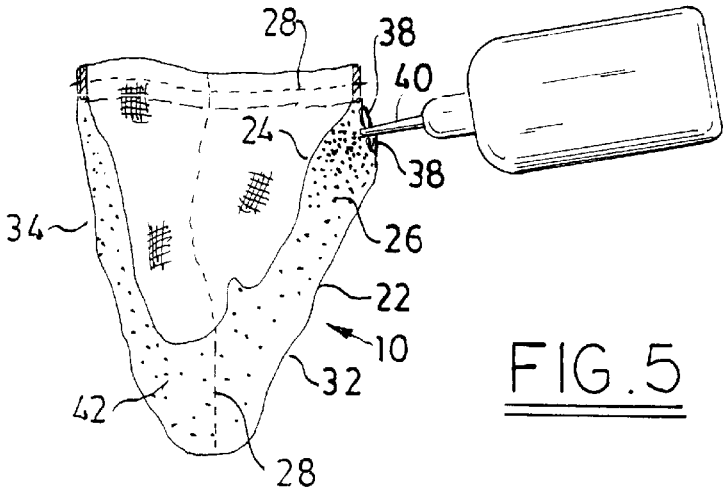
FIG. 5 is a sectional view of the foot protector of FIG. 1, illustrating how material may be introduced into such foot protector through a hole in the foot protector.

FIG. 5 illustrates the foot protector 10 in a stretched configuration, such as, e.g., the stretched configuration which is normally present when a foot is disposed within and stretches the foot protector 10. In the situation depicted in FIG. 5, the space 26 between sheets of fabric 22 and 24 is relatively large, and it is relatively easy to introduce material through hole 20 into space 26.

Any desired material, in either solid, liquid, and/or gaseous form, may be introduced through hole 20 into space 26. Thus, by way of illustration and not limitation, one may introduce in to hole 10 by means of applicator 40 substances such as scented material in either solid, liquid, and/or gaseous form (e.g., cologne, perfume, deodorants), antifungal agents, microbial agents, absorbents, adsorbents, creams, gels, pain killers, glitter, pigment, etc.

In one embodiment, the material 42 introduced into space 26 is volatilizable at a temperature of less than about 98 degrees Fahrenheit. Such volatilizable materials are well known to those skilled in the art and are described, e.g., in U.S. Pat. Nos. 5,019,434 (perfume-volatilizable product), 5,429,180, 5,045,574, 4,161,283, 3,994,439, 3,779,848, and the like. The disclosure of each of these United States patents hereby incorporated by reference into this specification.

Thus, by way of illustration and not limitation, and as disclosed in U.S. Pat. No. 5,139,864, the material 42 introduced into space 26 may consist essentially of a continuous, discontinuous non-particulate or discontinuous particulate solid, semi-solid, or gel porous or nonporous suspension agent containing a first volatilizable substance. The entire disclosure of this patent is hereby incorporated by reference into this specification.

Thus, by way of further illustration, and as is disclosed in U.S. Pat. No. 4,161,283, the volatilizable substance may be selected from the group consisting of perfumes, medicaments, deodorants, anti-germicidal agents, and mixtures thereof.

Thus, by way of further illustration, and as is disclosed in U.S. Pat. No. 3,994,439, the volatilizable material 42 is a perfume with a boiling point of from about 150 to about 300 degrees Centigrade which is dispersed in a polymeric mixture.

Figure 6:
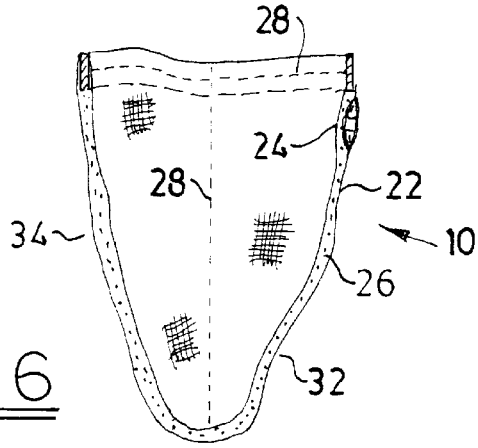
FIG. 6 is a sectional view of the foot protector of FIG. 5, illustrating its configuration when the foot protector is not in a stretched condition.

In one preferred embodiment, the volalizable material 42 is dispersed on or in a particulate material, such as a powder. Thus, e.g., scented baby powder may be used as the material FIG. 6 illustrates the stocking protector 10 in a non-stretched condition, which will exist, e.g., when a user's foot is not disposed within the protector 10.

Figure 7:
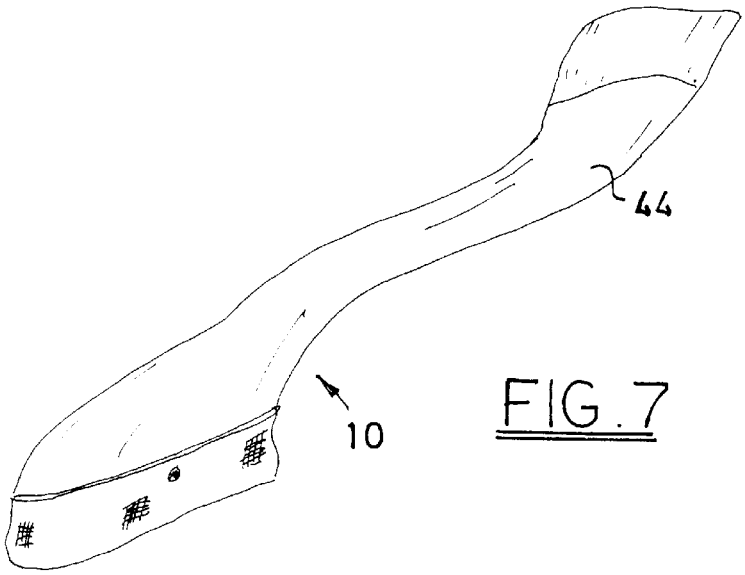
FIG. 7 is a perspective view of another embodiment of the foot protector of this invention, showing it integrally connected to a stocking.

FIG. 7 illustrates another embodiment of this invention, in which a stocking protector 10 is integrally connected to a conventional stretch nylon stocking 44.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

Thus, in one embodiment, the foot protector 10 of this invention can be worn underneath a conventional stocking.

The foot protector 10 of this invention can be a variety of different sizes. Thus, e.g., it can be "low cut" (only enclosing the toes), "mid-cut" (which covers up to the middle of the foot) ankle length, knee length, or panty hose. All of these embodiments are within the scope of the invention as defined by the following claims.

In another embodiment, an article of clothing made by the process of this invention is used to surround a wearer's crotch. Thus, e.g., underpants may be made with the laminated fabric/hole system of this invention.

In yet another embodiment, an article of clothing made by the process of this invention is to make the absorbent portion of a brassiere.

In yet another embodiment, a headband is made by the process of this invention.

In yet another embodiment, a sheer body suit is made by the process of this invention.

I claim:

1. A foot protector which is comprised of at least about 80 weight percent of a fabric material, wherein:

(a) said fabric material is comprised of at least 50 weight percent of stretch fabric, (b) said fabric material is comprised of a first sheet of fabric, a second sheet of fabric, and a space disposed between said first sheet of fabric and said second sheet of fabric, wherein:

(1) at least about 95 percent, by volume, of said space is enclosed by said first sheet of fabric and said second sheet of fabric, (2) a hole extends through said first sheet of fabric, wherein said hole has a diameter of less than about 0.3 inches, and (c) a volatilizable material is disposed within said space disposed between said first sheet of fabric and said second sheet of fabric.

2. The foot protector as recited in claim 1, wherein said hole is a reinforced hole.

3. The foot protector as recited in claim 2, wherein said hole is reinforced with fabric.

4. The foot protector as recited in claim 2, wherein said hole is reinforced with a grommet.

5. The foot protector as recited in claim 2, wherein said foot protector is an integral structure in the form of a sock.

6. The foot protector as recited in claim 2, wherein said first sheet of fabric is joined to said second sheet of fabric.

7. The foot protector as recited in claim 6, wherein said first sheet of fabric is joined to said second sheet of fabric by stitching.

8. The foot protector as recited in claim 2, wherein said volatilizable material is a solid material.

9. The foot protector as recited in claim 2, wherein said volatilizable material is a liquid material.

10. The foot protector as recited in claim 2, wherein said volatilizable material is selected from the group consisting of cologne, perfume, deodorant, and mixtures thereof.

11. The foot protector as recited in claim 2, wherein said volatilizable material is an antifungal agent.

12. The foot protector as recited in claim 2, wherein said volatilizable material is a microbial agent.

13. The foot protector as recited in claim 2, wherein said volatilizable material is volatilizable at a temperature of less than about 98 degrees Fahrenheit.

14. The foot protector as recited in claim 2, wherein said volatilizable material is an anti-germicidal agent.

15. The foot protector as recited in claim 2, wherein said volatilizable material is a perfume with a boiling point of from about 150 to about 300 degrees Centigrade.

* * * * *